US005186290A

United States Patent [19]

Takayama

[11] Patent Number: 5,186,290

[45] Date of Patent: Feb. 16, 1993

[54] COMBINATION TRUNK

[76] Inventor: Hiromitsu Takayama, 3-45, Takaido-Nishi, 2-chome, Suginami-ku, Tokyo, Japan

[21] Appl. No.: 828,383

[22] Filed: Jan. 30, 1992

[51] Int. Cl.[5] ..... A45C 1/02; A45C 3/06

[52] U.S. Cl. ..... 190/108; 190/110; 190/111

[58] Field of Search ..... 190/21, 103, 108, 109, 190/110, 111, 112

[56] References Cited

U.S. PATENT DOCUMENTS

| | | | |
|---|---|---|---|
| 1,084,360 | 1/1914 | Rahn | 190/108 |
| 2,428,906 | 10/1947 | Cannella | 190/108 |
| 3,061,057 | 10/1962 | Miller | 190/111 |
| 3,319,744 | 5/1967 | Smith | 190/108 |
| 3,696,850 | 10/1972 | Rosenblum | 190/110 |
| 3,837,447 | 9/1974 | Honan | 190/108 |
| 4,081,061 | 3/1978 | Tucker | 190/108 |
| 4,086,945 | 5/1978 | Carter | 190/109 |
| 4,122,925 | 10/1978 | Schultheiss | 190/108 |
| 4,424,841 | 1/1984 | Smith | 190/110 |
| 4,621,716 | 11/1986 | Rienäcker | 190/108 |
| 4,673,070 | 6/1987 | Ambal | 190/108 |
| 4,693,345 | 9/1987 | Mittelmann | 190/108 |
| 4,759,431 | 7/1988 | King et al. | 190/108 |
| 4,995,436 | 2/1991 | Cantor | 190/108 |
| 5,105,920 | 4/1992 | Grebenstein | 190/111 |

FOREIGN PATENT DOCUMENTS

| | | | |
|---|---|---|---|
| 3934760 | 4/1991 | Fed. Rep. of Germany | 190/108 |
| 2588455 | 4/1987 | France | 190/108 |
| 840343 | 7/1960 | United Kingdom | 190/110 |

*Primary Examiner*—Gary E. Elkins
*Attorney, Agent, or Firm*—Jordan and Hamburg

[57] ABSTRACT

The present invention is a combination baggage trunk comprising a set of covers and open or box frames which are sized in proper or integer ratio relationship and can thus be joined together to a baggage assembly containing a number of container spaces or to a combination of a shoulder bag, an attache case, a suitcase, etc.

10 Claims, 24 Drawing Sheets

COMBINATION TRUNK

BACKGROUND OF THE INVENTION

The present invention relates to a combination baggage trunk comprising a set of covers and open or box frames which are sized in proper or integer ratio relationship and can thus be joined together to a baggage assembly containing a number of container spaces or to a combination of a shoulder bag, an attache case, a suitcase, etc.

A known combination trunk is comprised mainly of covers and open frames to which the covers are detachably mounted for closing two opening sides, or box frames of which opening side is closed with the cover, which all are arranged in size for assembly in desired combinations.

The known combination trunk can have a large container space with two or more of the frames being coupled to each other in a depthwise direction. However, such an arrangement, fails to provide a plurality of container spaces and will thus be limited in use.

Also, coupling of the frames involves an increase in the overall width, but not length nor height.

SUMMARY OF THE INVENTION

It is an object of the present invention, in view of the foregoing disadvantages of the prior art, to provide a combination trunk in which the covers can be coupled to each other in a desired combination for producing a plurality of container spaces which are different in size.

It is another object of the present invention to provide a combination trunk comprising a plurality of covers and open or box frames which are sized in integer ratio relationship and can be assembled to a desired form, e.g. a shoulder bag, an attache case, or a suit case and to a combination of e.g. a suit case accompanied with an attache case and a shoulder bag.

BRIEF DESCRIPTION OF THE DRAWINGS

Other objects and features of the present invention will be apparent from reading of the detailed description in conjunction with the accompanying drawings.

The drawings are provided for ease of the description and will not limit the present invention.

DETAILED DESCRIPTION OF THE PREFERRED EMBODIMENTS

Figure 1:
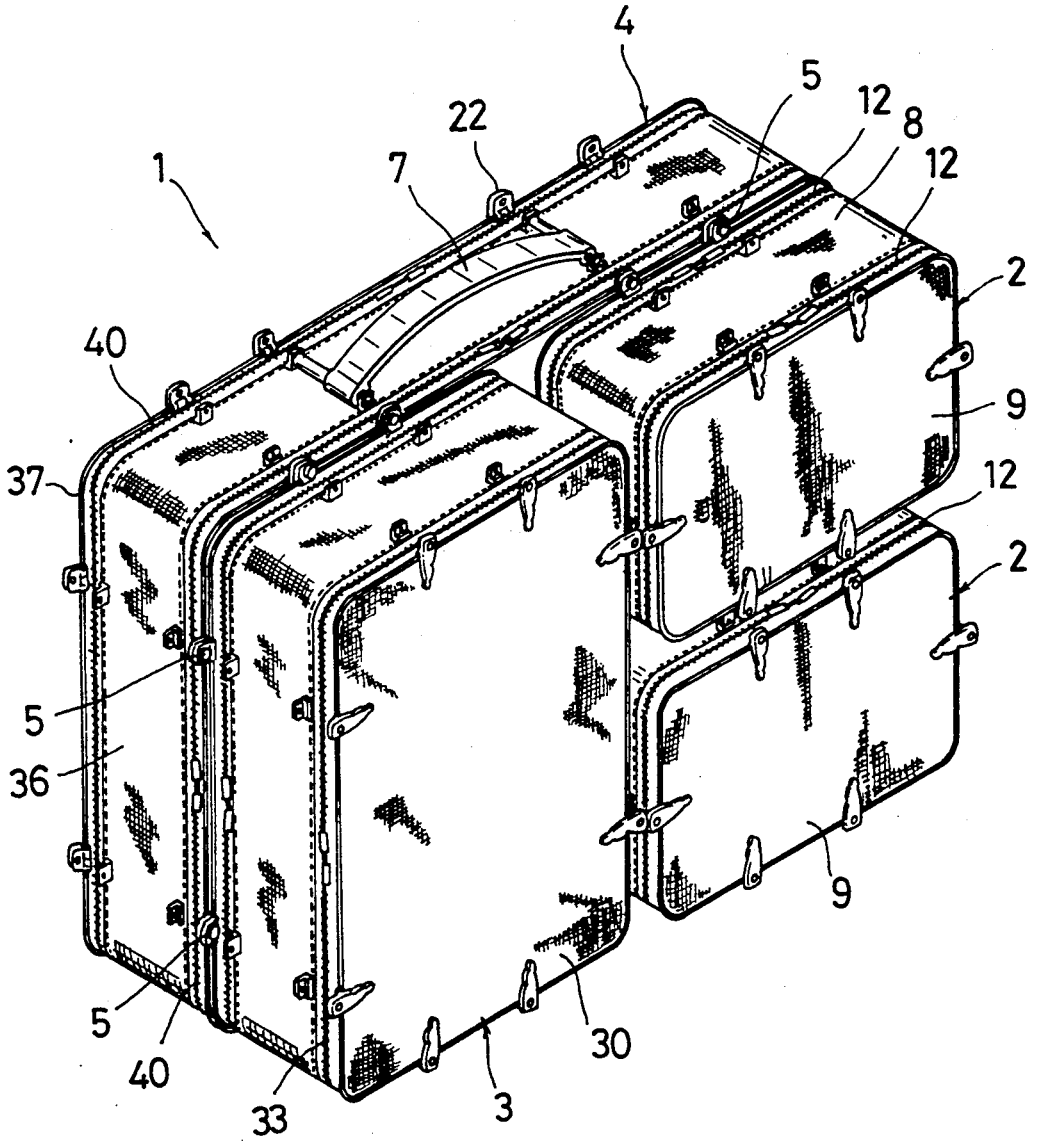
FIG. 1 is a perspective view showing a first embodiment of the present invention.
Figure 2:
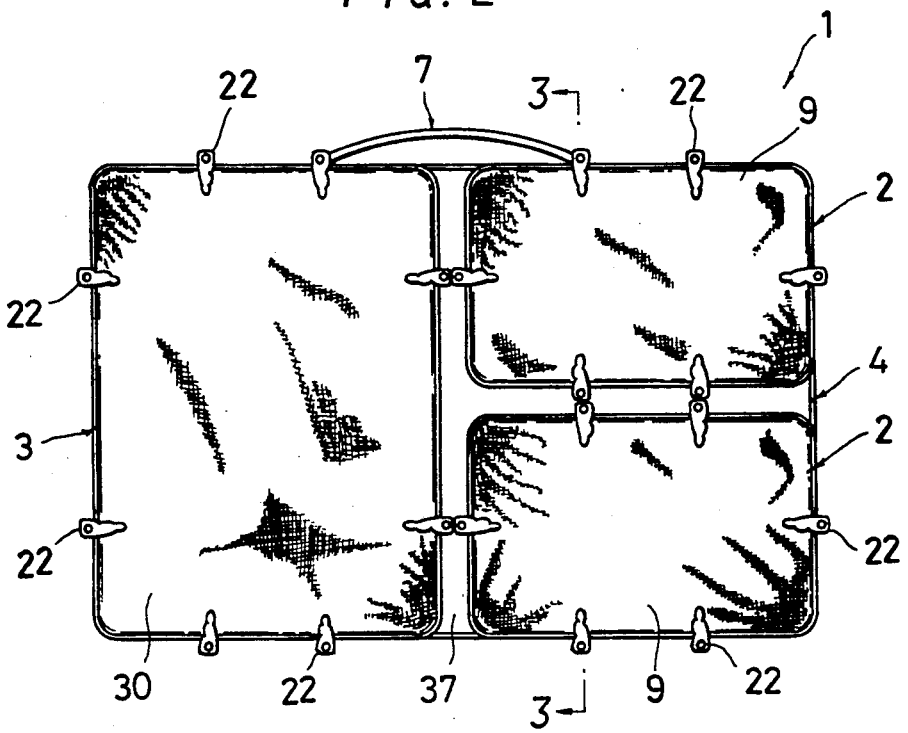
FIG. 2 is a front view of the same.
Figure 3:
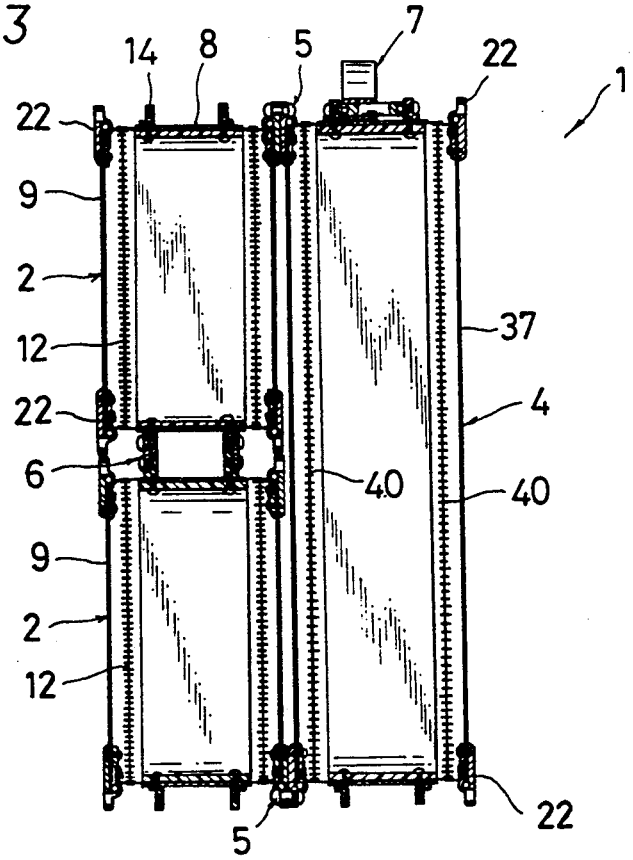
FIG. 3 is a cross sectional view taken along the line 3—3 of FIG. 2.

Embodiments of the present invention will be described in more detail referring to the accompanying drawings.

In FIGS. 1 to 26, a first embodiment of the present invention is illustrated in the form of a combination trunk 1 comprising two small-sized component cases 2,2 of a size appropriate for use as shoulder bags, a medium-sized component case 3 about two times greater in size than the small-sized case 2 for use as an attache case and detachably coupling to the two small-sized cases 2,2, a large-sized component case 4 about two times greater in size than the medium-sized case 3 for use as a suit case and detachably coupling to the medium-sized case 3, joiners 5 and 6 for coupling in depthwise, upward, downward, left, and right directions between the small-sized cases 2,2, medium-sized case 3, and large-sized case 4, and a handle grip 7 mounted to the large-sized case 4.

Figure 4:
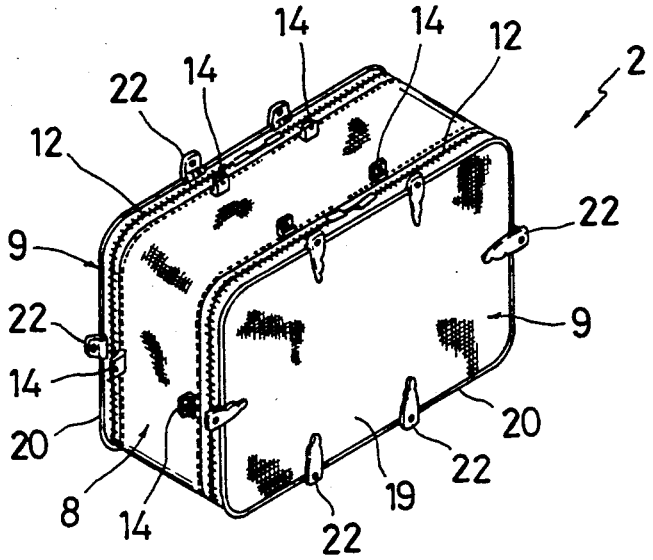
FIGS. 4 to 6 are explanatory views showing a small-sized component case.
Figure 5:
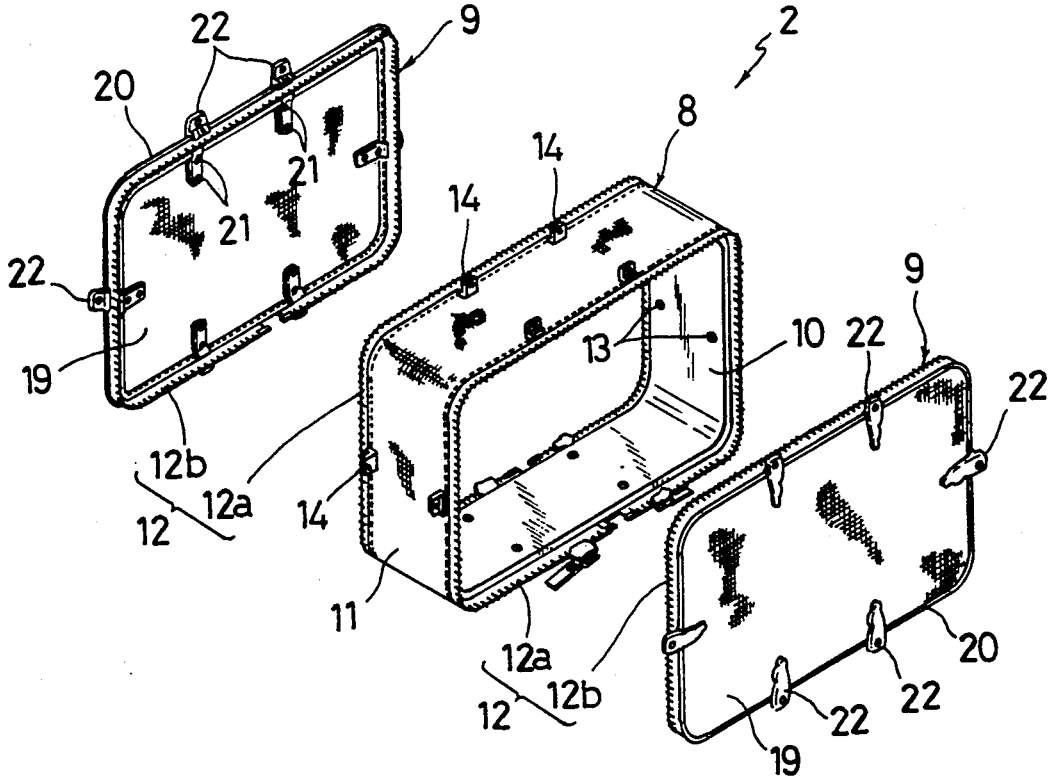
Figure 6:
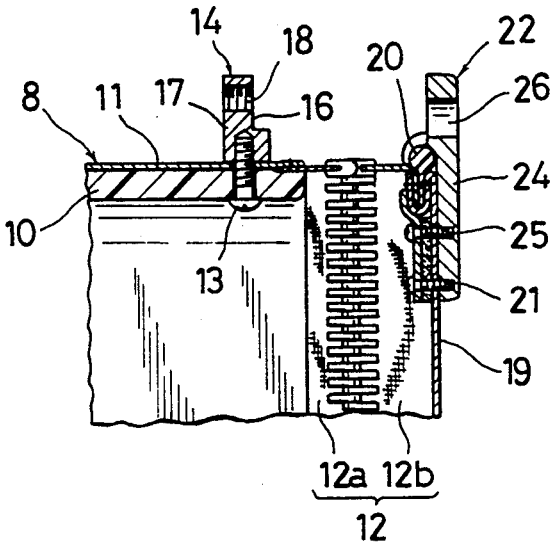

The small-sized component case 2 is comprised mainly of a small-sized frame 8 of four-sided tubular shape and two small-sized covers 9,9 openably covering the two opening sides of the small-sized frame 8, as shown in FIGS. 4 to 6. The small-sized frame 8 comprises a small-sized frame structure of four-sided tubular shape made of synthetic resin or wooden sheet material, a small-sized outer frame coat 11 of e.g. natural or synthetic leather material or cloth material fixedly bonded by an adhesive to the outer sides of the frame structure 10, two toothed strips 12*a*, 12*a* of a zip-fastener 12 sewed down to both depthwise edges of the outer frame coat 11, and six pairs of joiner blocks 14; eight of the blocks are mounted by screws 13 to the depthwise edges of the upper and lower sides of the small-sized frame structure 10 so that they extend outward and stay at a $\frac{1}{3}$ distance from the widthwise end of the outer frame coat 11 and four are similarly mounted to the depthwise edges of the left and right sides of the frame structure 10 so that they extend outward from the center portions of the left and right sides of the outer frame coat 11.

Figure 7:
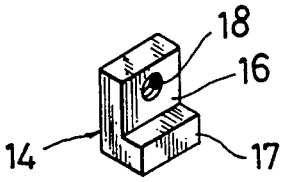
FIGS. 7 and 8 are explanatory views showing a joiner block.
Figure 8:
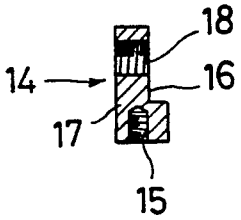

As best shown in FIGS. 7 and 8, the joiner block 14 has a screw hole 15 provided in the bottom thereof for accepting the screw 13, a joining plate hold recess 16 provided in a main body 17 thereof, and a threaded slot 18 provided at the joining plate hold recess 16 of the main body 17.

The small-sized cover 9 comprises a small-sized main body 19 made of e.g. natural or synthetic leather material or cloth material, the other toothed strip 12*b* of the zip-fastener 12 sewed down by a rib flange 20 to the outer edge of the main body 19, and six depthwise joiners 22; four of these joiners are mounted by pairs of screws 21 to the upper and lower edges of the small-sized main body 18 so that they extend outward, stay at a $\frac{1}{3}$ distance from the widthwise end, and engage with the rib flange 20 and two are similarly mounted to the center portions of the left and right ends of the main body 19 so that they extend outward and engage the rib flange 20.

Figure 9:
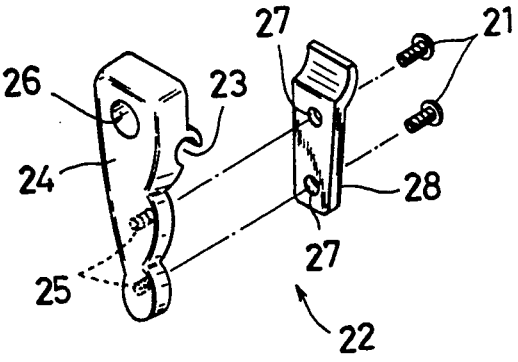
FIGS. 9 and 10 are explanatory views showing a depthwise joiner.
Figure 10:
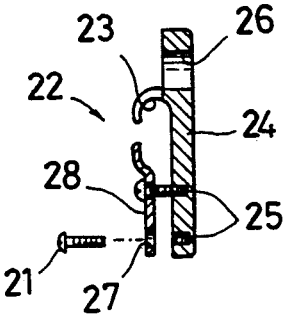

As best shown in FIGS. 9 and 10, the depthwise joiner 22 is comprised mainly of an outer piece 24 and an inner piece 28. The outer piece 24 has at its center a rib flange hold recess 23, an upper joining slot 26, and two screw holes 25,25 at its lower rear for accepting the screws 21, 21. The inner piece 28 disposed to the rear of the outer piece 24 has two screw slots 27,27 provided in given locations thereof corresponding to the two screw holes 25,25 of the outer piece 24.

Figure 11:
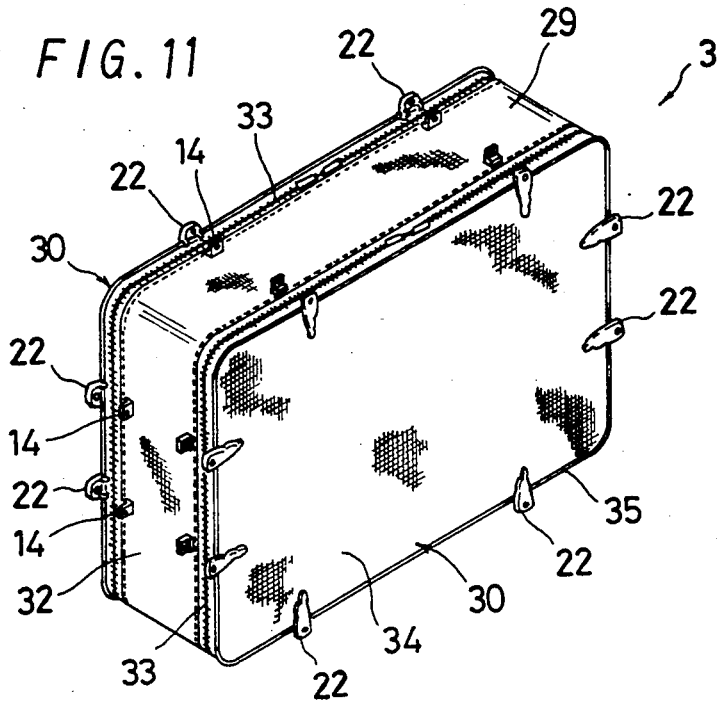
FIGS. 11 to 13 are explanatory views showing a medium-sized component case.
Figure 12:
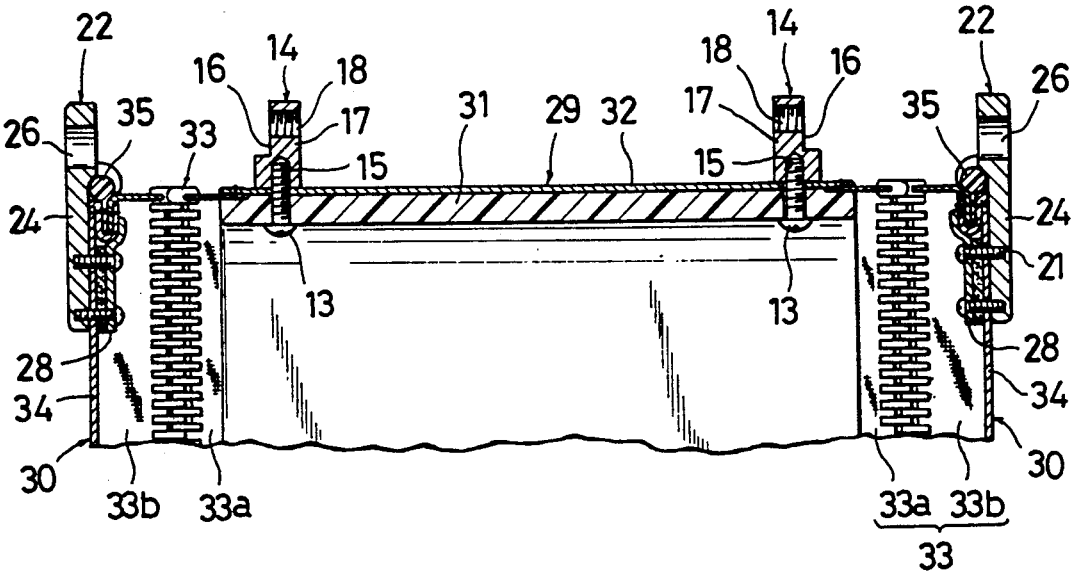
Figure 13:
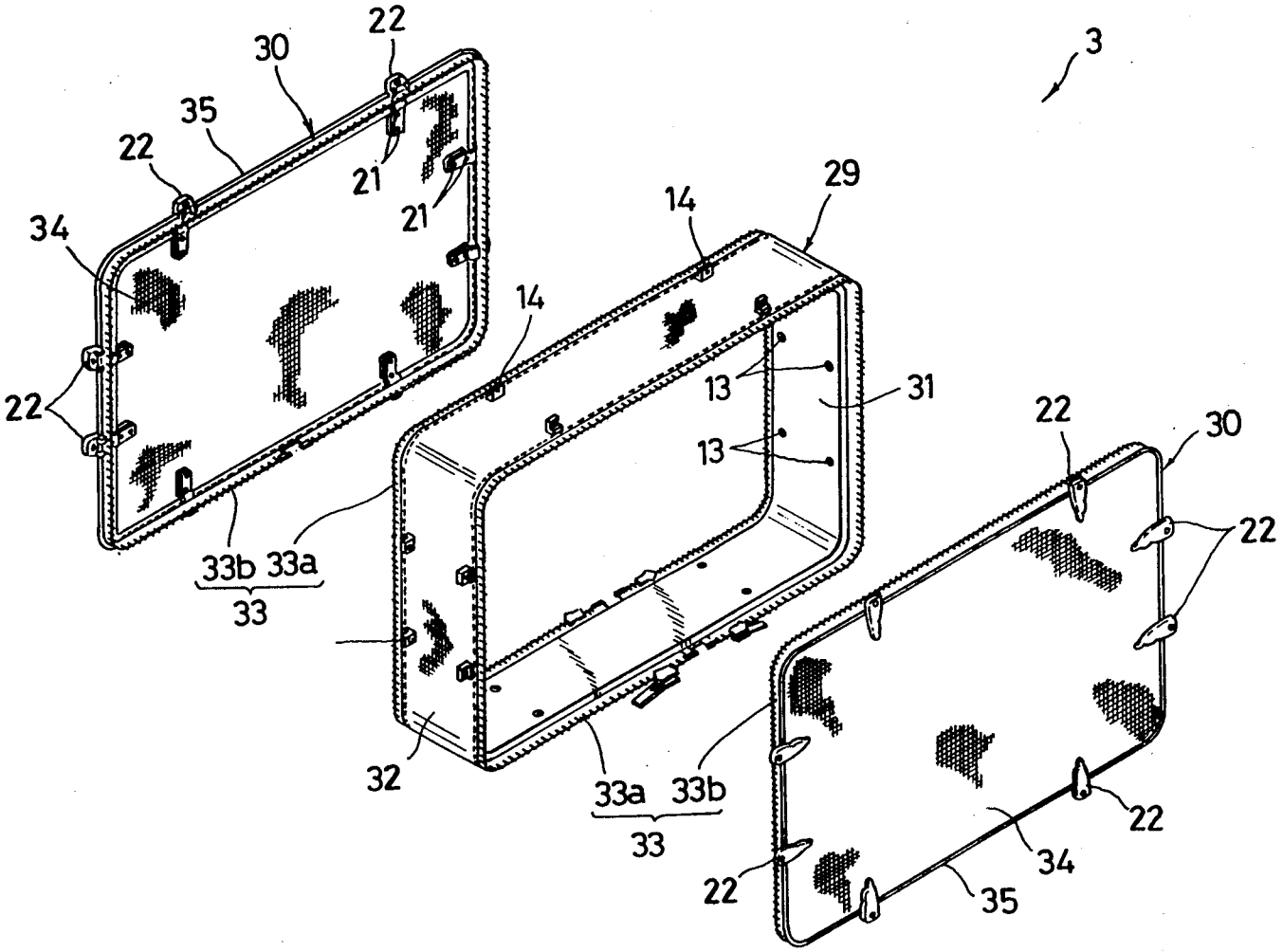

The medium-sized component case 3 is comprised mainly of a medium-sized frame 29 of four-sided tubular shape about two times greater in size than that of the small-sized case 2 and two medium-sized covers 30,30 openably covering the two opening sides of the medium-sized frame 29, as shown in FIGS. 11 to 13. The medium-sized frame 29 comprises a medium-sized frame structure 31 of four-sided tubular shape made of synthetic resin or wooden plate material, a medium-sized outer frame coat 32 of e.g. natural or synthetic leather material or cloth material fixedly bonded by an adhesive to the outer sides of the frame structure 31, two toothed strips 33*a*, 33*a* of a zip-fastener 33 sewed down to both depthwise edges of the outer frame coat 32, and eight pairs of the joiner blocks 14; eight are mounted by the screws 13 to the upper and lower sides of the medium-sized frame structure 31 so that they extend outward and stay at a ¼ distance from the widthwise end of the outer frame coat 32 and the remaining eight are mounted by the screws 13 to the left and right sides of the frame structure 31 so that they extend outward and stay at a ⅓ distance from the upper or lower end of the outer frame coat 32.

Similarly, the medium-sized cover 30 comprises a medium-sized main body 34 made of e.g. natural or synthetic leather material or cloth material, the other half portion 33*b* of the zip-fastener 33 sewed down by a rib flange 35 to the outer edge of the main body 34, and eight of the depthwise joiners 22; four of these joiners are mounted by the pair screws 21 to the upper and lower edges of the medium-sized main body 34 so that they extend outward, stay at a ¼ distance from the widthwise end, and engage the rib flange 35 and the remaining four are mounted by the same to the left and right sides of the main body 34 so that they extend outward, stays at a ⅓ distance from the upper or lower end, and engage with the rib flange 35.

Figure 14:
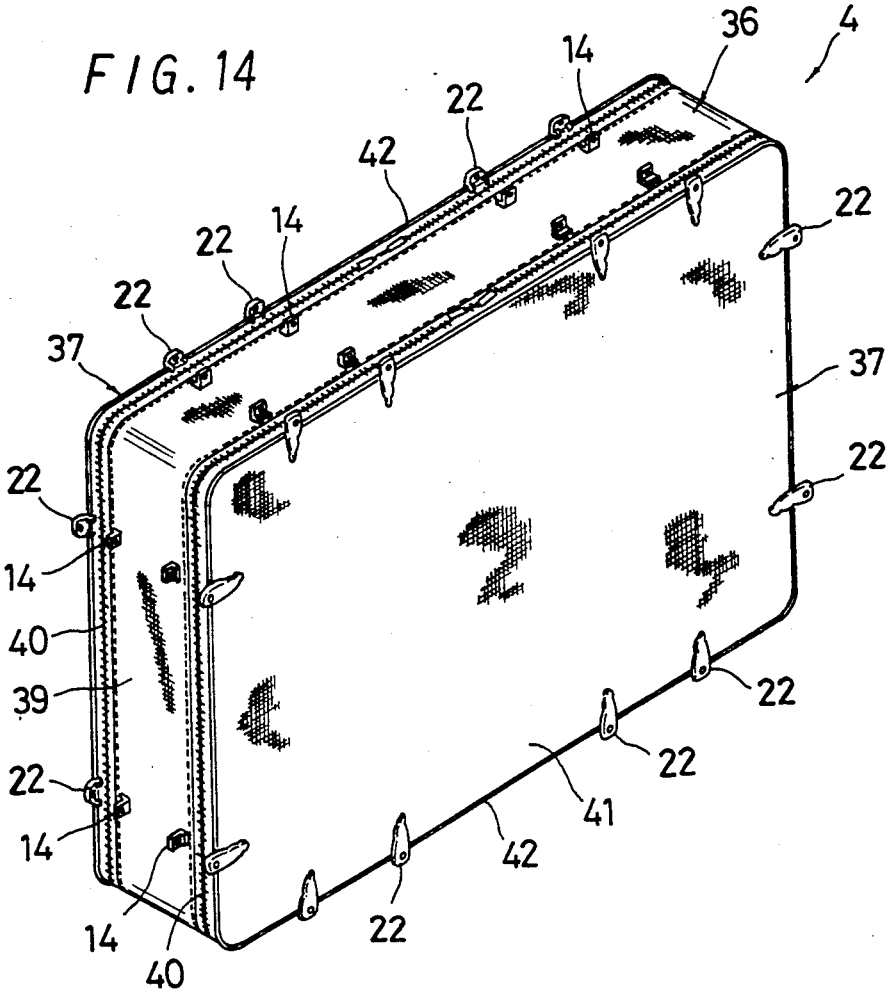
FIGS. 14 to 16 are explanatory views showing a large-sized component case.
Figure 15:
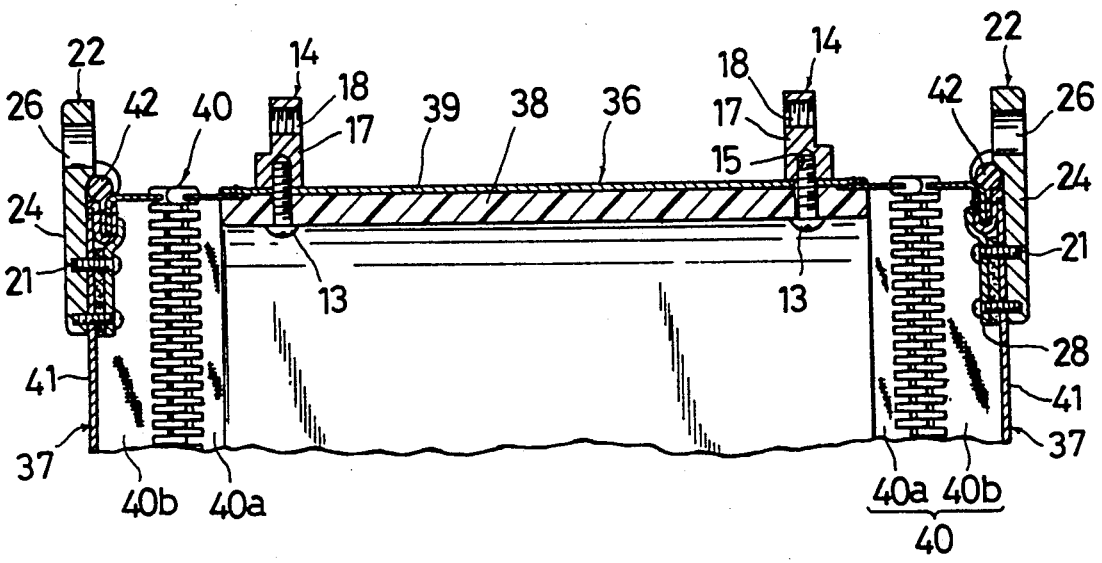
Figure 16:
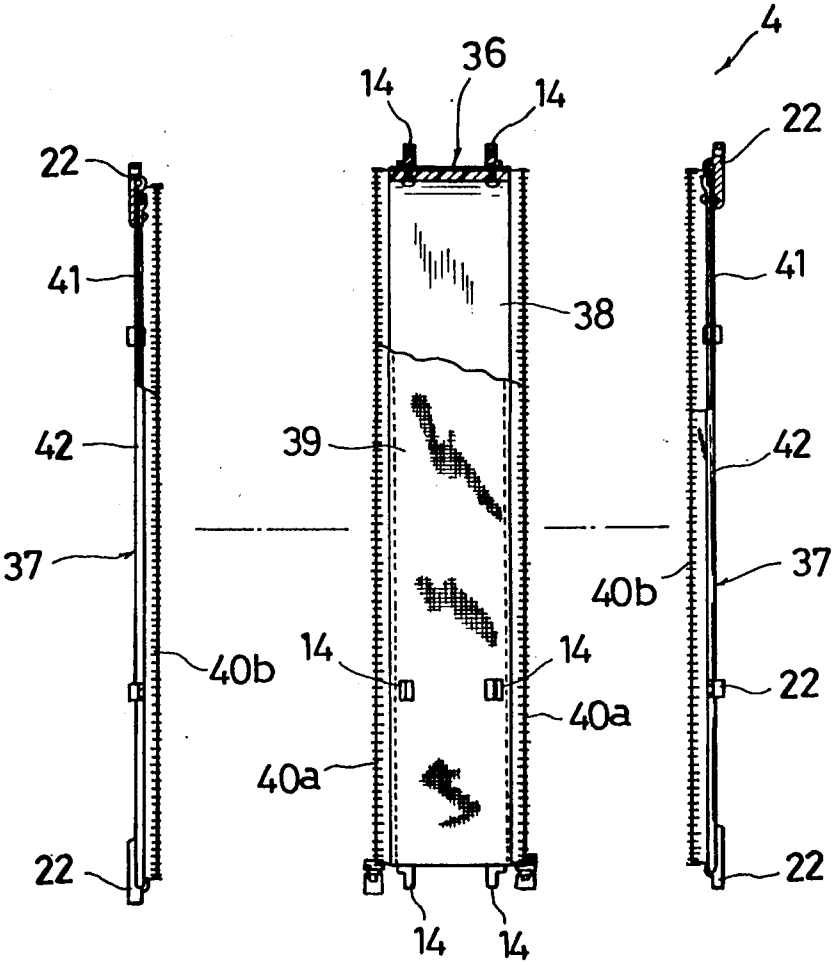

The large-sized component case 4 is comprised mainly of a large-sized frame 36 of four-sided tubular shape about two times greater in size than that of the medium-sized case 3 and two large-sized covers 37,37 openably covering the two opening sides of the large-sized frame 36, as shown in FIGS. 14 to 16. The large-sized frame 36 comprises a large-sized frame structure 38 of four-sided tubular shape made of synthetic resin or wooden sheet material, a large-sized outer frame coat 39 of e.g. natural or synthetic leather material or cloth material fixedly bonded by an adhesive to the outer sides of the frame structure 38, two toothed strips 40*a*,40*a* of a zip-fastener 40 sewed down twelve pairs of the joiner blocks 14; sixteen of these joiner blocks are mounted by the screws 13 to the upper and lower sides of the large-sized frame structure 38 so that they extend outward and stay at 1/6 and 2/6 distances from the widthwise end of the outer frame coat 39 and the remaining eight are mounted by the screws 13 to the left and right sides of the frame structure 38 so that they extend outward and stay at a ¼ distance from the upper or lower end of the outer frame coat 39.

Similarly, the large-sized cover 37 comprises a large-sized main body 41 made of e.g. natural or synthetic leather material or cloth material, the other toothed strip 40*b* of the zip-fastener 40 sewed down by a rib flange 42 to the outer edge of the main body 41, and twelve of the depthwise joiners 22; eight of the joiners are mounted by the pair screws 21 to the upper and lower edges of the large-sized main body 41 so that they extend outward, stay at 1/6 and 2/6 distances from the widthwise end, and engage the rib flange 42 and four are mounted by the same to the left and right sides of the main body 41 so that they extend outward, stays at a ¼ distance from the upper or lower end, and engage the rib flange 42.

Figure 17:
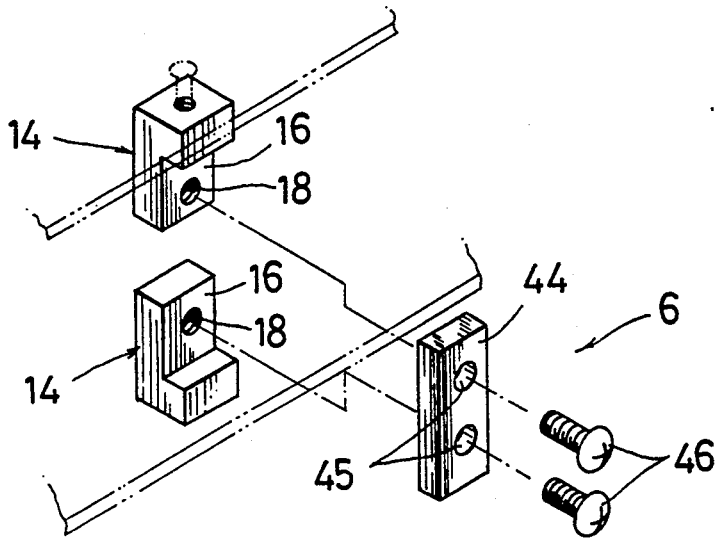
FIGS. 17 and 18 are explanatory views showing a plate joiner.
Figure 18:
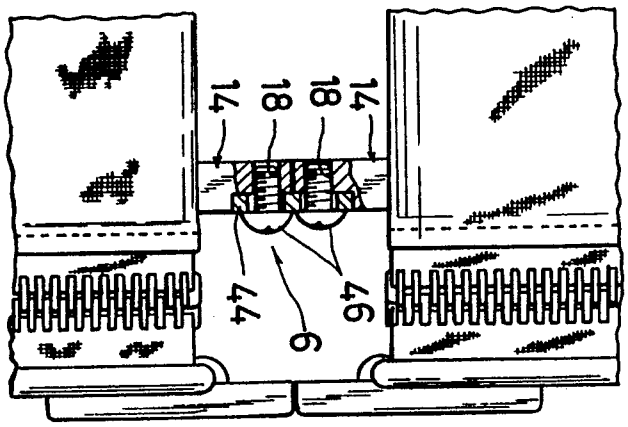

The plate joiner 6 for coupling the two small-sized cases 2,2 to each other in a vertical direction or to the medium-sized case 3 in a widthwise direction comprises a joining plate 44 having two screw holes 45,45 provided therein at locations corresponding to the two screw holes 18,18 of their respective joiner blocks 14,14 so that it can be held between the two joining plate hold recesses 16,16 of the same, and two screws 46,46 for screwing through the two screw holes 45,45 of the joining plate 44 into the two screw holes 18,18 of their respective joiner blocks 14,14 for fastening, as shown in FIGS. 17 and 18.

Figure 19:
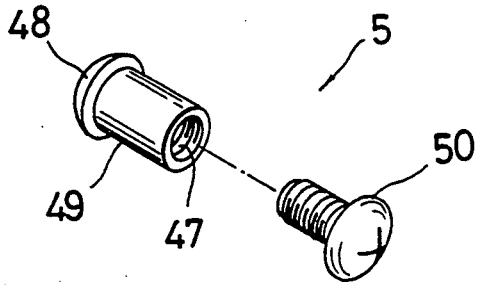
FIGS. 19 and 20 are explanatory views showing a screw joiner.
Figure 20:
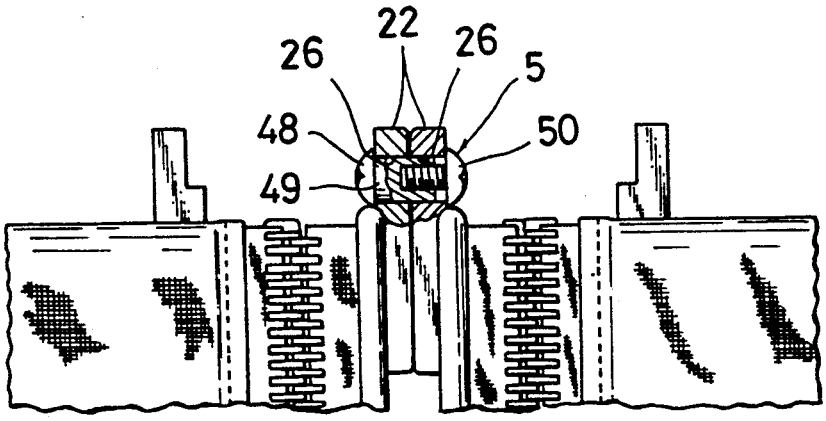

The screw joiner 5 for coupling the two small-sized cases 2,2, the medium-sized case 3, and the large-sized case 4 to each other in a depthwise direction is comprised mainly of a threaded piece 49 having at one end a screw hole 47 provided therein and at the other end a head 48 thereof, and a screw 50 for screwing into the screw hole 47 of the threaded piece 49 for fastening the two joiner blocks 22,22 to each other in the depthwise direction, as shown in FIGS. 19 and 20.

Figure 21:
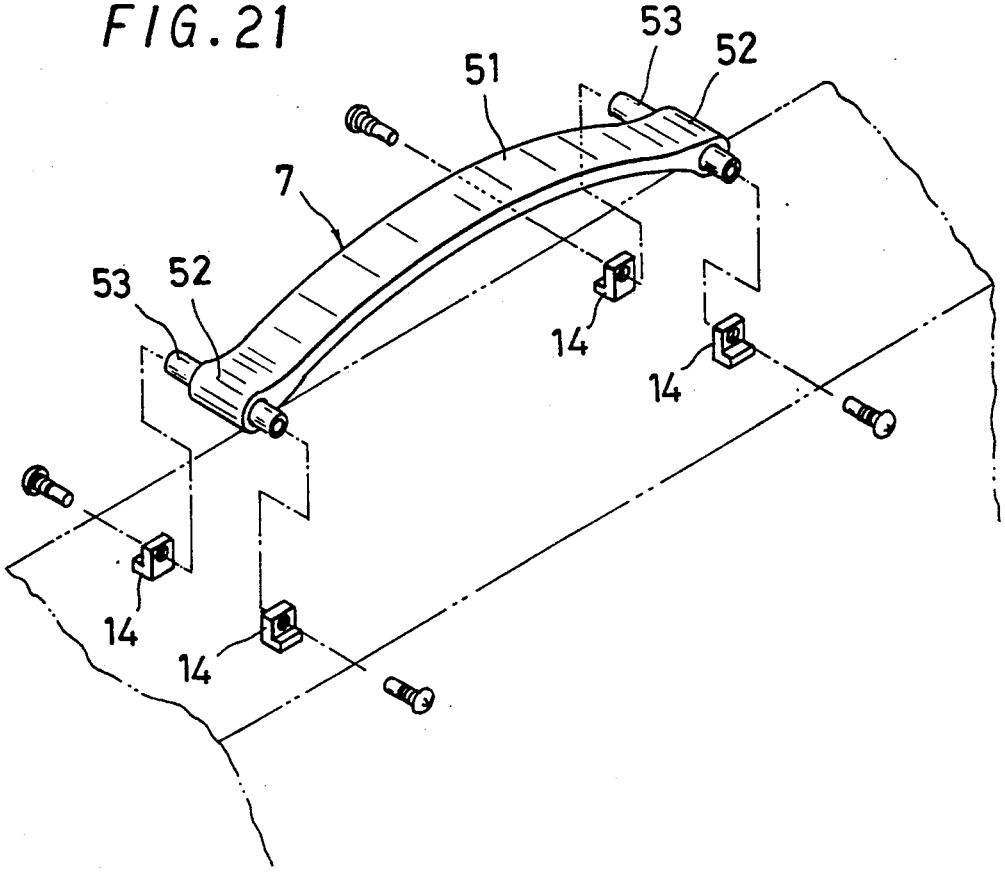
FIGS. 21 and 22 are explanatory views showing a handle grip.
Figure 22:
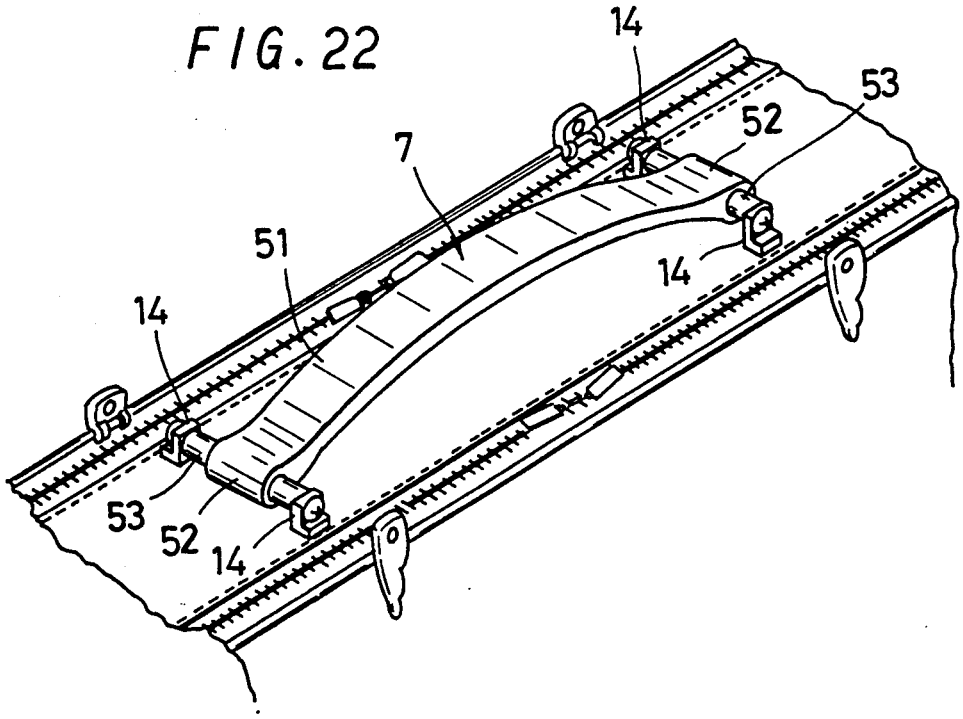

The handle grip 7 comprises, as shown in FIGS. 21 and 22, a handle 51 and two joining pins 53,53 mounted at both ends to their respective pairs of the joiner blocks 14,14 disposed on the central region of the upper side of the large-sized case 4 for movably coupling the two ends 52,52 of the handle 51 to the joiner blocks 14,14,14,14.

According to the foregoing arrangement of the combination trunk 1, the two covers 9,9 of each of the two smallsized cases 2,2 can be opened by releasing their respective zip-fasteners 12,12. Also, the covers 30,30 of the medium-sized case 3 and the covers 37,37 of the large-sized case 4 can be opened by releasing the zip-fasteners 33,33,40,40 respectively.

Figure 23:
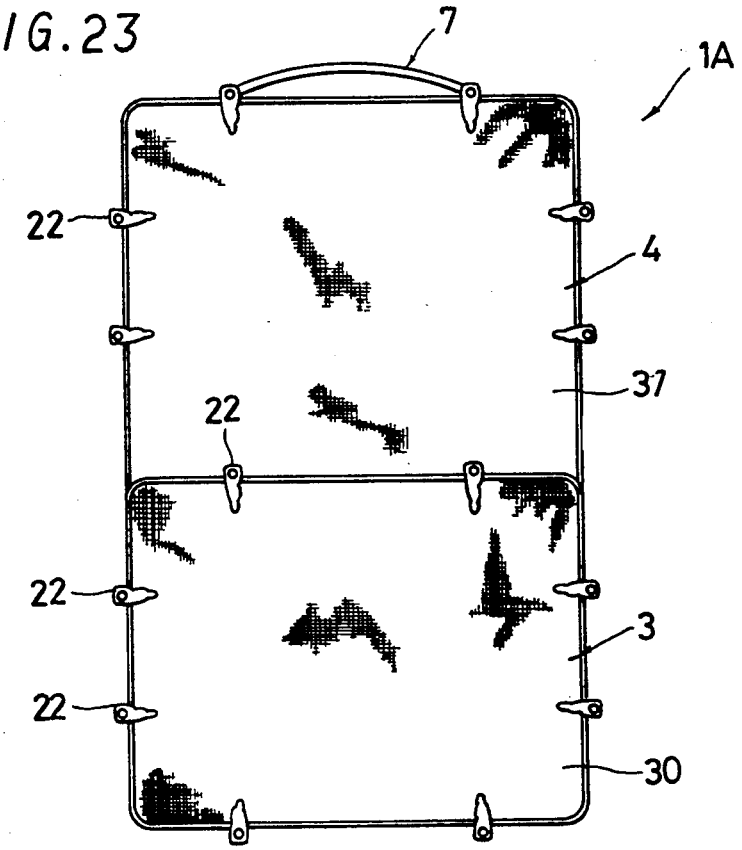
FIGS. 23 and 24, 25 and 26, 27 and 28, and 29 and 30 are explanatory views showing different combinations of the component cases.
Figure 24:
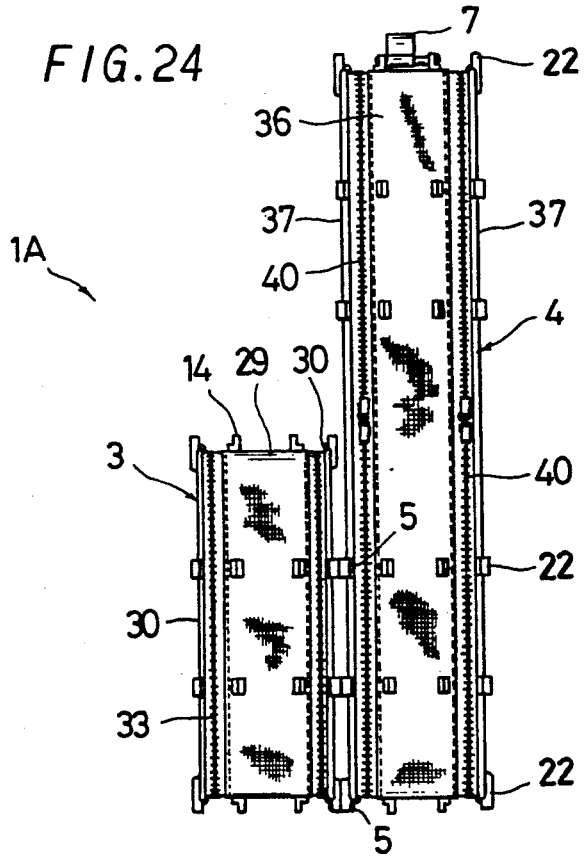
Figure 25:
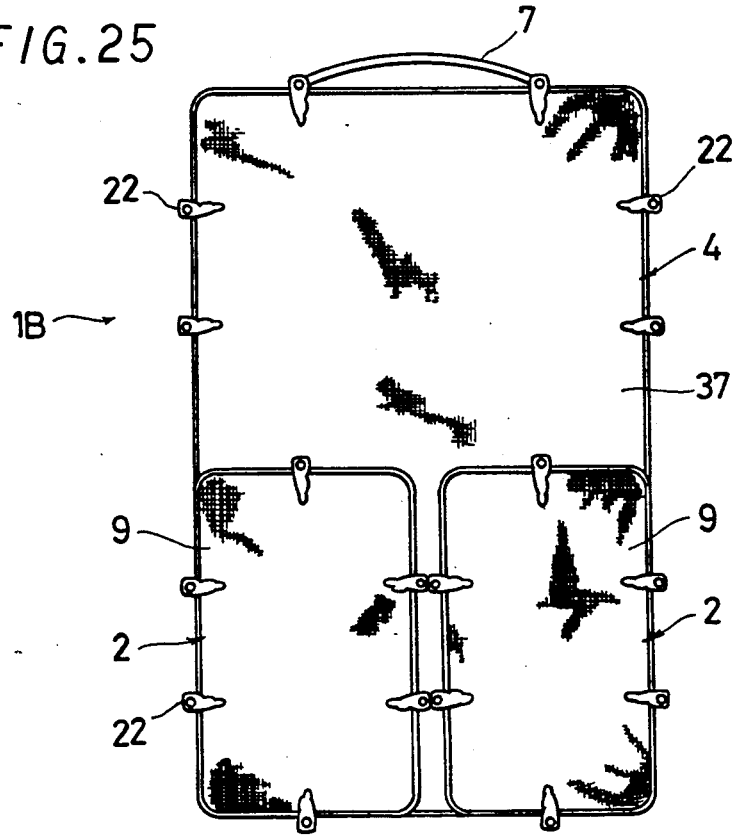
Figure 26:
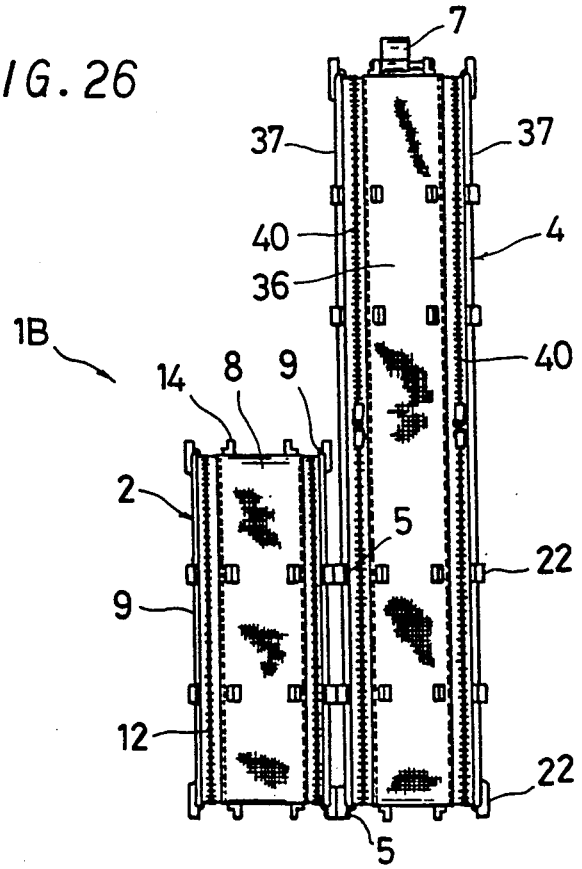
Figure 27:
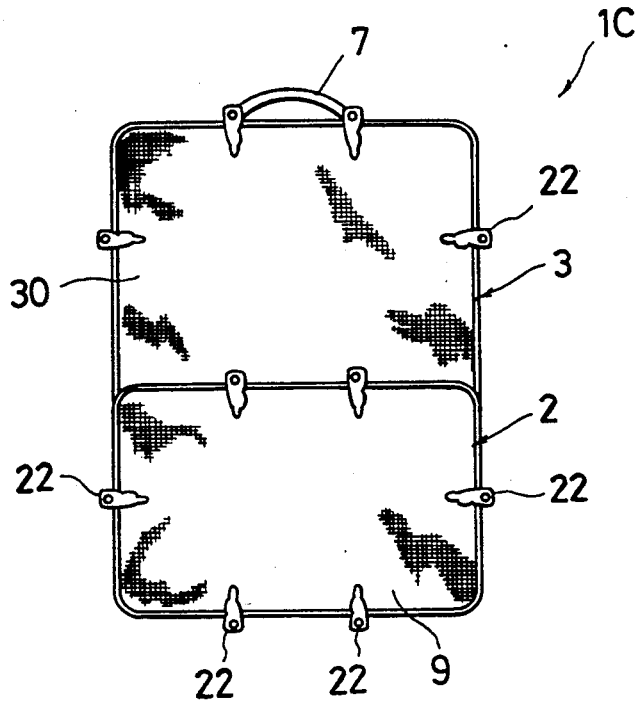
Figure 28:
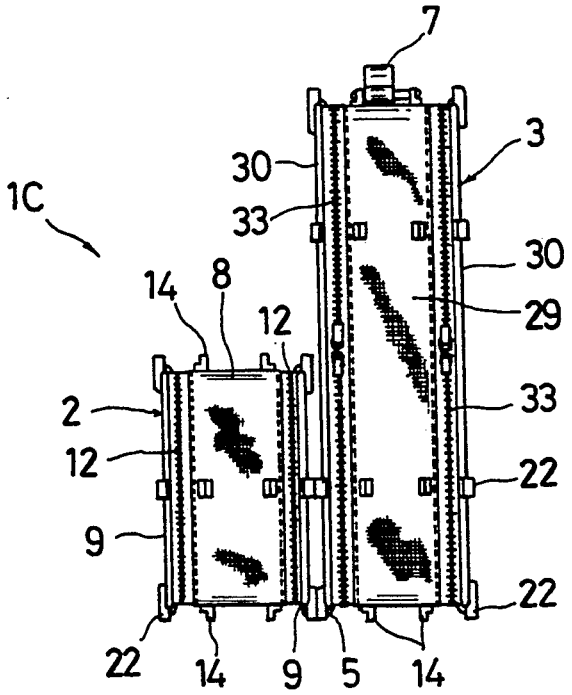
Figure 29:
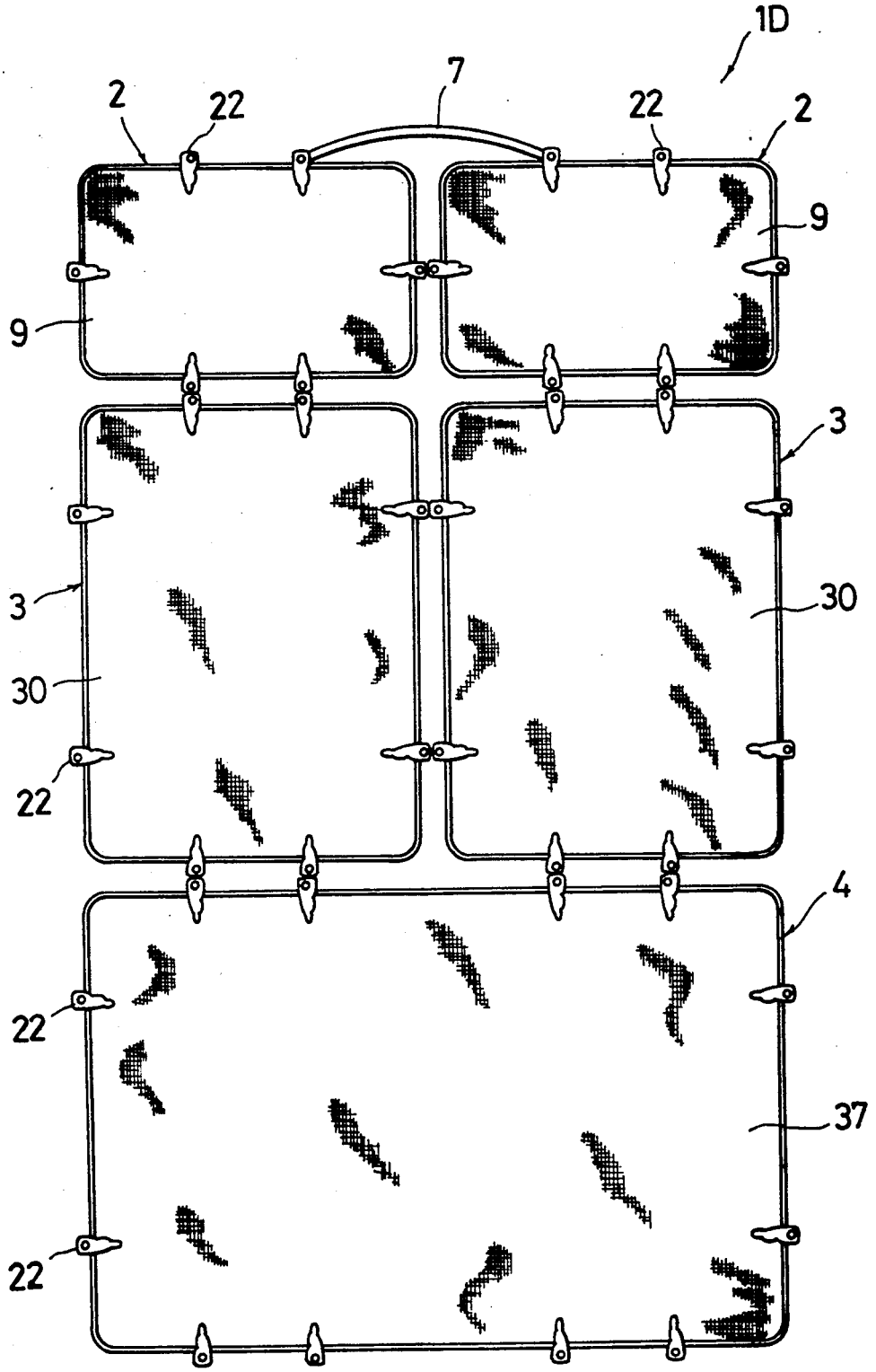
Figure 30:
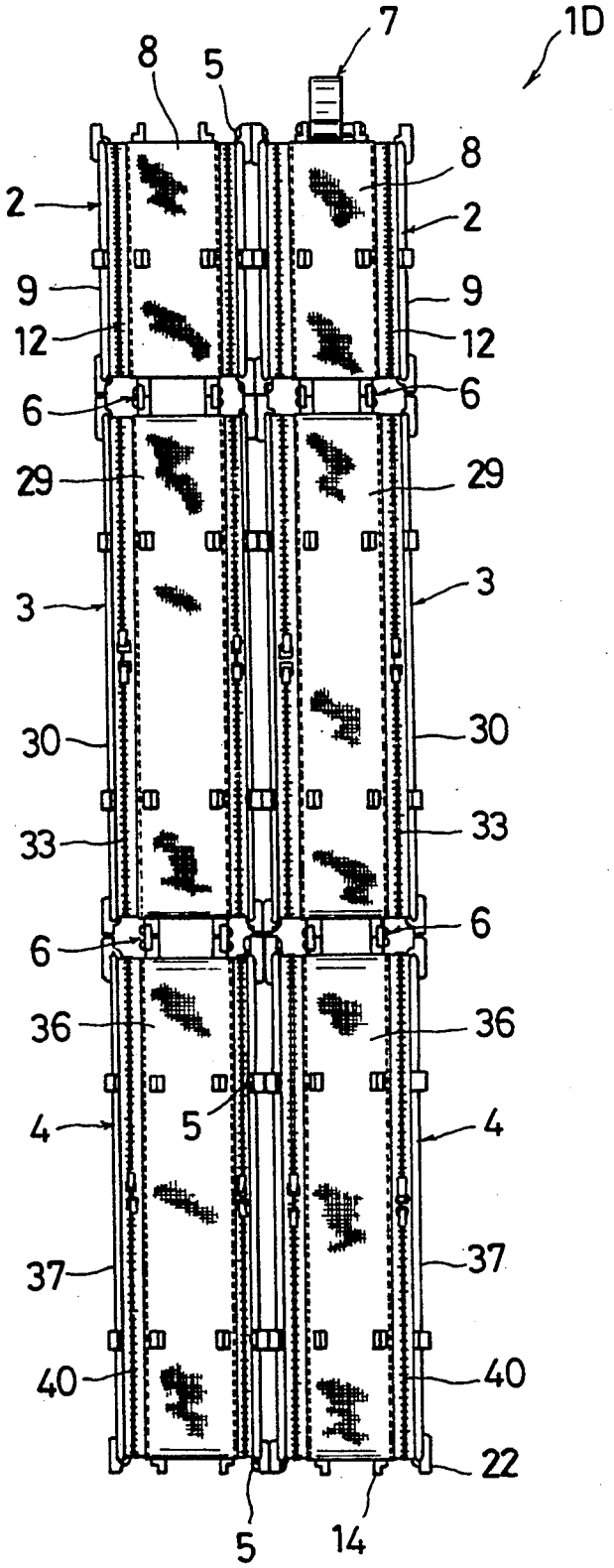

Each combination trunk 1 is comprised mainly of a large-sized component case 4, a medium-sized component case 3, two small-sized component cases 2,2, joiners 5 and 6, and a handle grip 7 so that a variety of combinations of the component cases can be erected. For example, one large-sized case 4 and one medium-sized can be assembled to an assembly unit 1A as illustrated in FIGS. 23 and 24, a large-sized case 4 and two small-sized cases 2,2 can be assembled to an assembly unit 1B as illustrated in FIGS. 25 and 26, a medium-sized case 3 and two small-sized cases 2,2 can be assembled to an assembly unit 1C as illustrated in FIGS. 27 and 28, two large-sized cases 4,4, four medium-sized cases 3,3,3,3 and four small-sized cases 2,2,2,2 can be assembled together to an assembly unit 1D, and so on.

Figure 31:
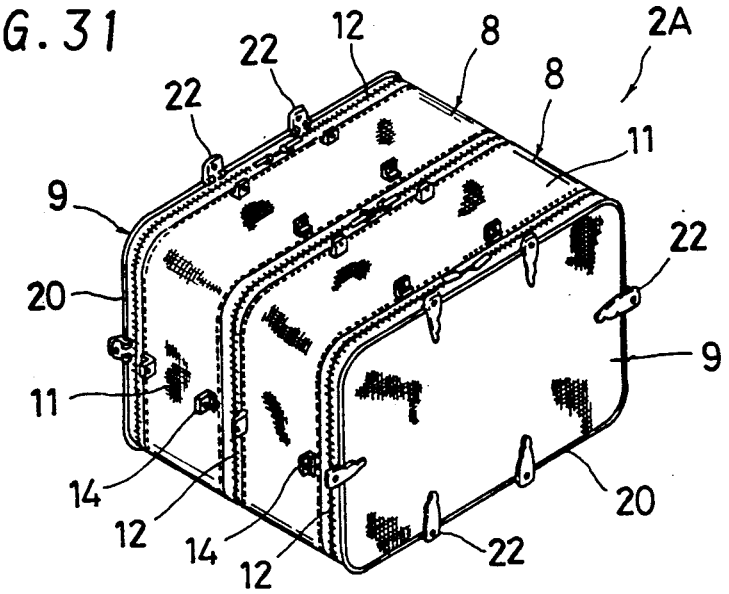
FIGS. 31 and 32 are explanatory views showing another arrangement of the small-sized component case.
Figure 32:
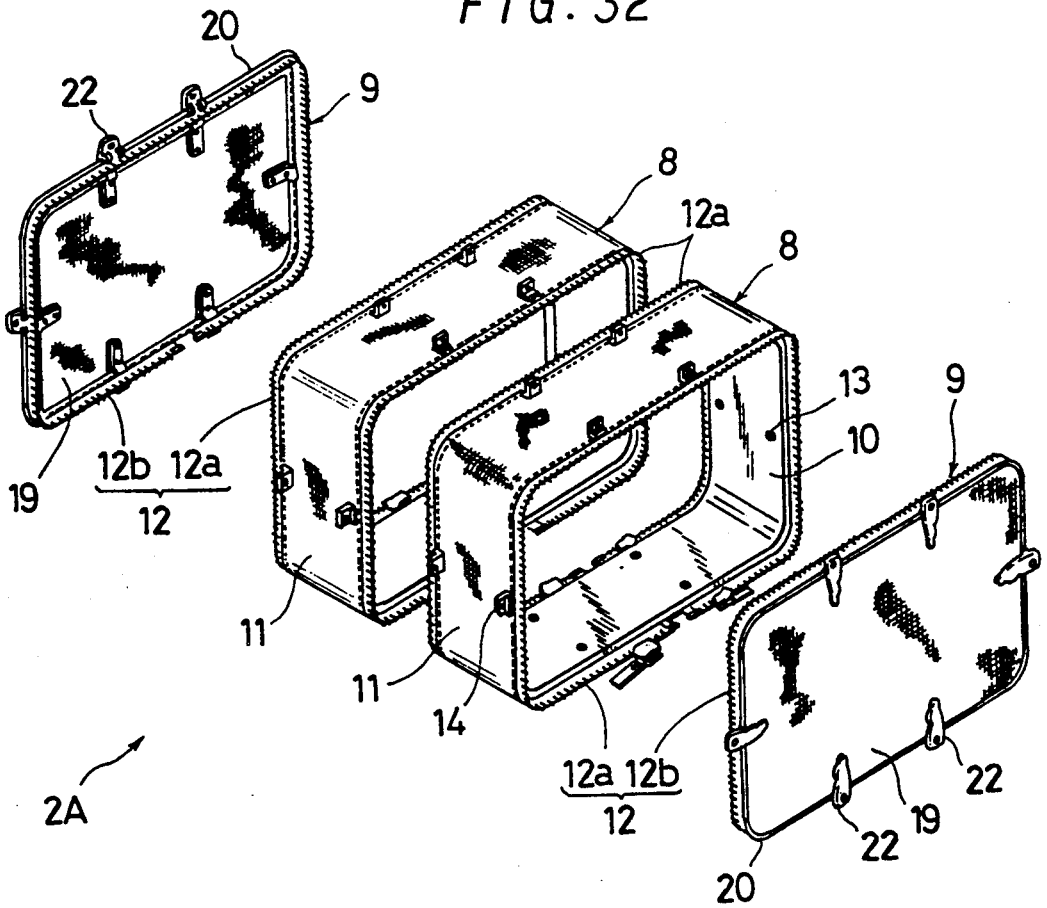

Also, the two small-sized frames 8,8 can be coupled to each other by the zip-fastener 12 thus producing a smallsized case assembly unit 2A which is about two times greater in container size than the small-sized case 2, as shown in FIGS. 31 and 32.

Equally, two or more of the frames 29 and 36 of their respective medium-sized and large-sized cases 3 and 4 can be coupled to one another with the zip-fasteners 33 and 40 respectively.

The other embodiments of the present invention will now be described referring to FIGS. 33 to 43. Like components identical to those of the first embodiment are denoted by like numerals throughout the drawings and will no more be explained.

Figure 33:
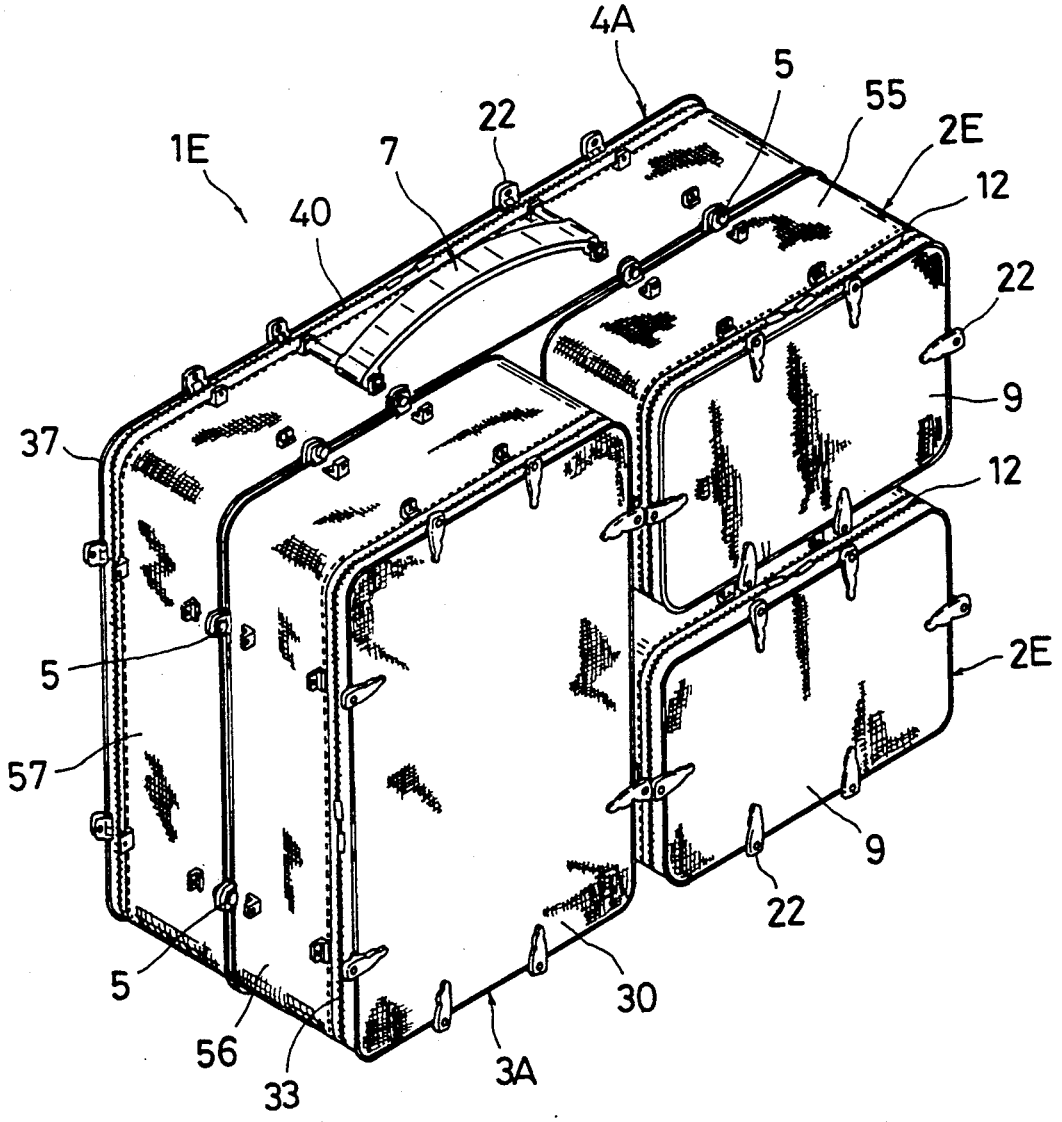
FIGS. 33 to 35, 36 and 37, 38 to 40, and 41 to 43 are explanatory views showing further embodiments of the present invention respectively.
Figure 34:
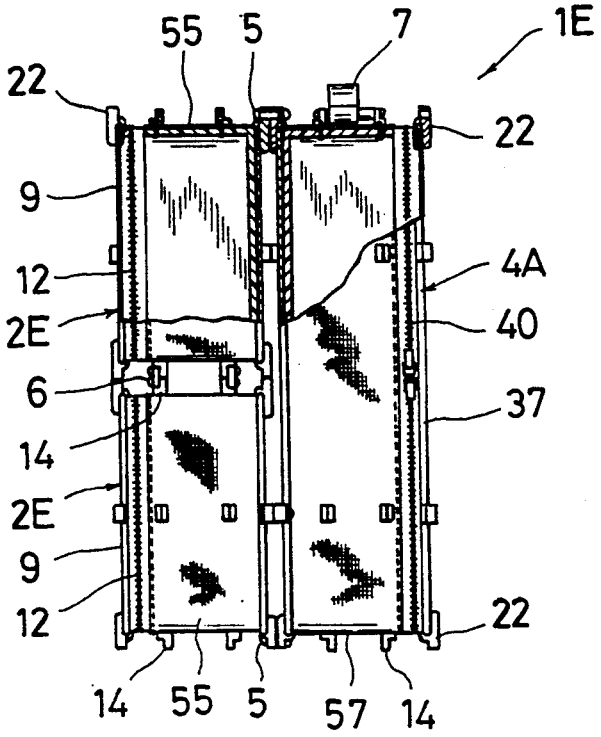
Figure 35:
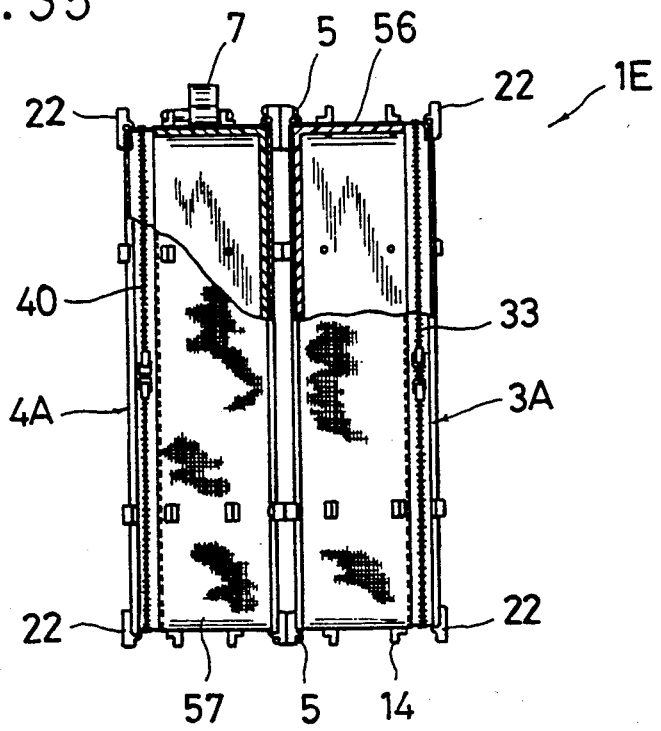

A second embodiment of the present invention shown in FIGS. 33 to 35 is distinguished from the first embodiment by the fact that each of two small-sized component cases 2E,2E comprises a small-sized box frame 55 closed at one side and a small-sized cover 9, a medium-sized component case 3A comprises a medium-sized box frame 56 closed at one side and a medium-sized cover 30, and a large-sized component case 4A comprises a large-sized box frame 57 closed at one side and a large-sized cover 37, which all constitute a combination trunk 1E. The combination trunk 1E comprising the two small-sized cases 2E,2E, the medium-sized case 3A, and the large-sized case 4A will offer the same advantages as the first embodiment of the present invention.

Figure 36:
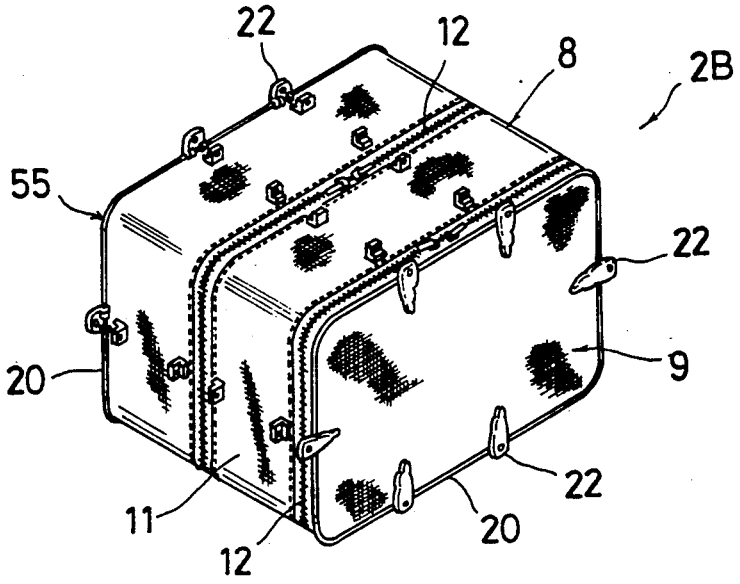
Figure 37:
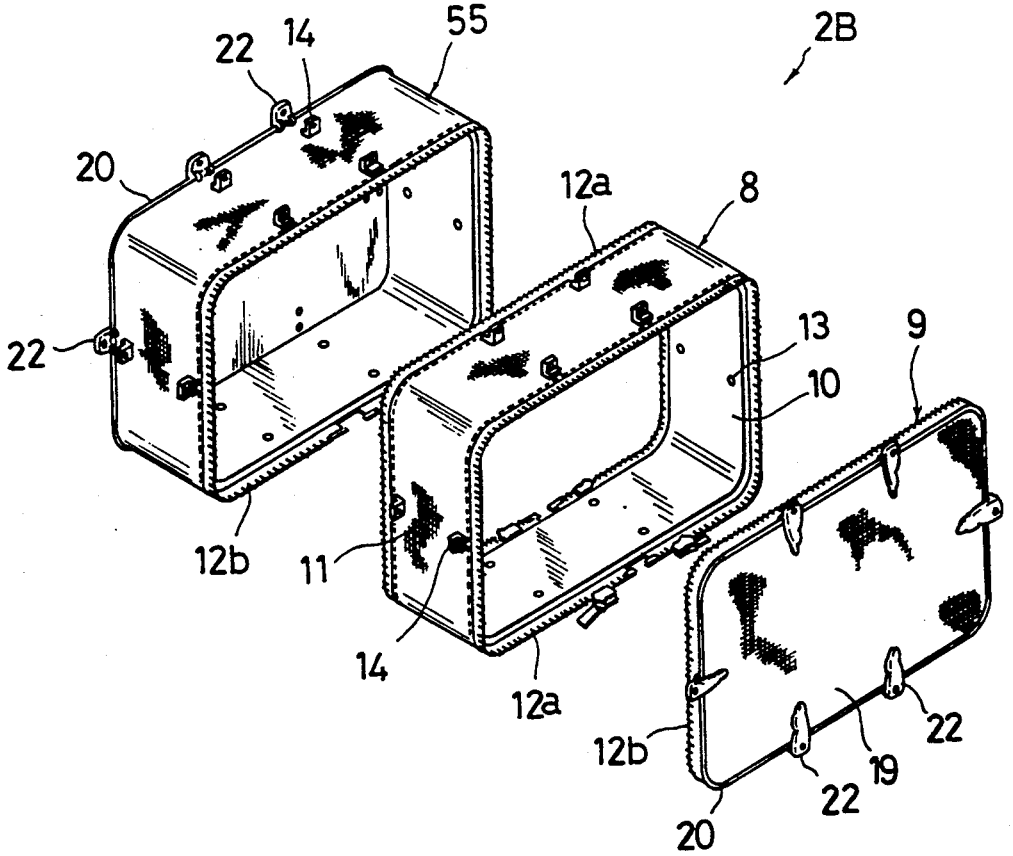

Another form of a small-sized component case 2B may be arranged using the small-sized box frame 55, the small-sized frame structure 8, and the small-sized cover 9, as shown in FIGS. 36 and 37.

Also, the medium-sized case 3A may be consisted mainly of a medium-sized box frame 56, a medium-sized frame structure 29, and a medium-sized cover 30. The large-sized case 4A may be consisted mainly of a large-sized box frame 57, a large-sized frame structure 36, and a large-sized cover 37.

Figure 38:
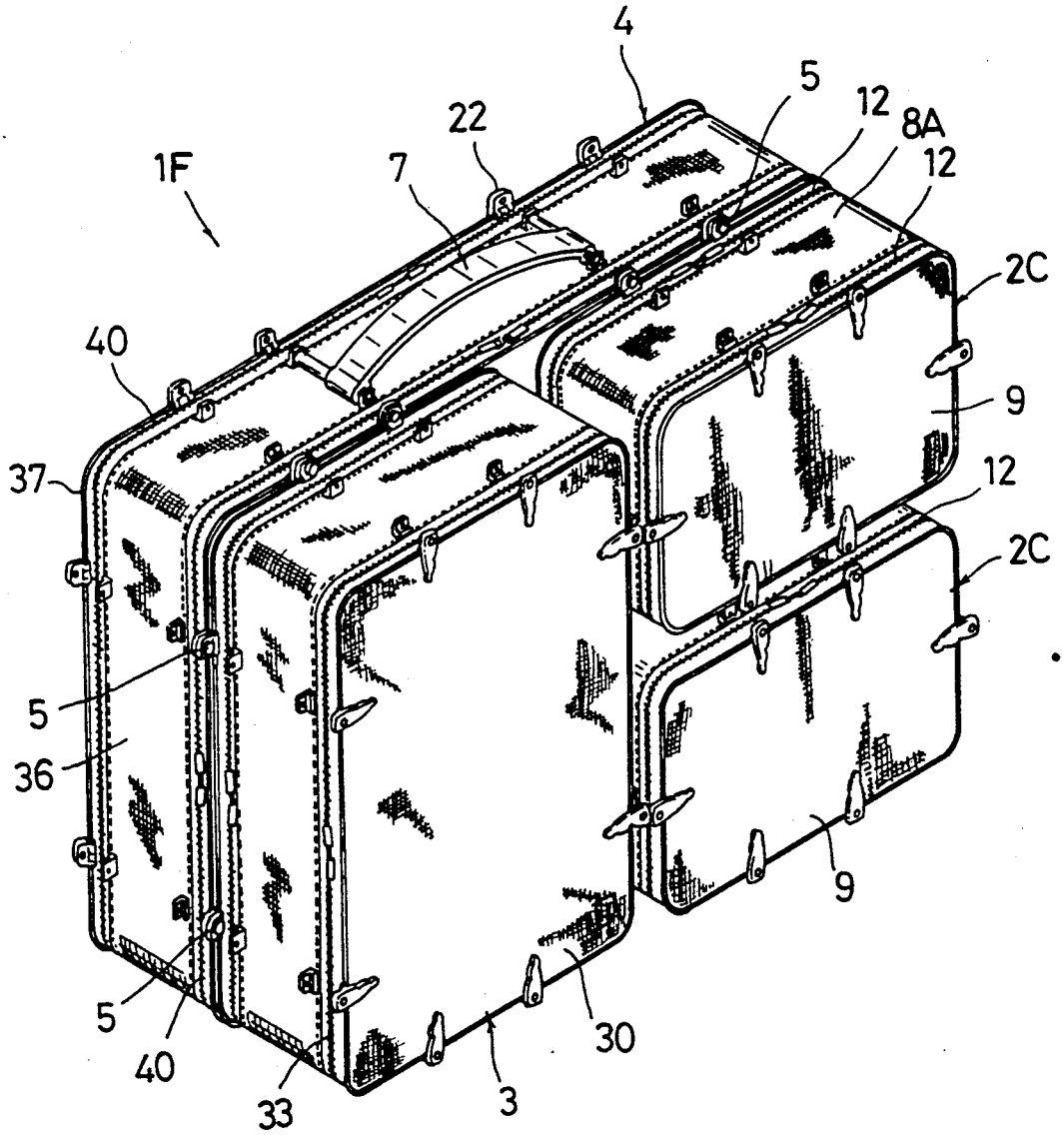
Figure 39:
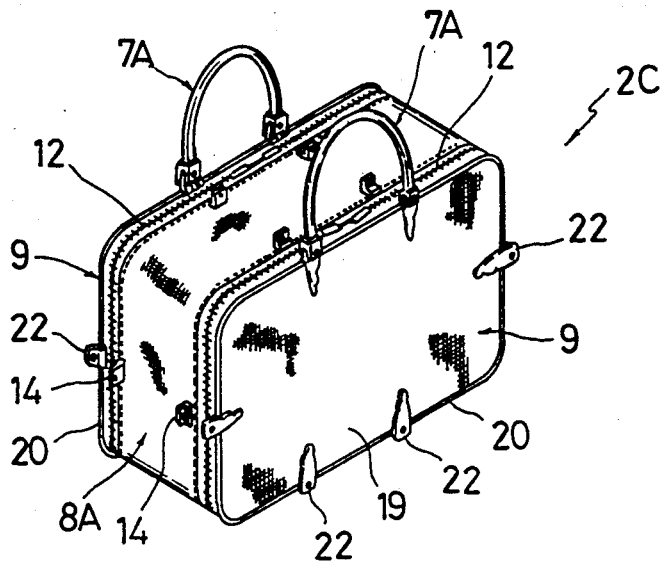
Figure 40:
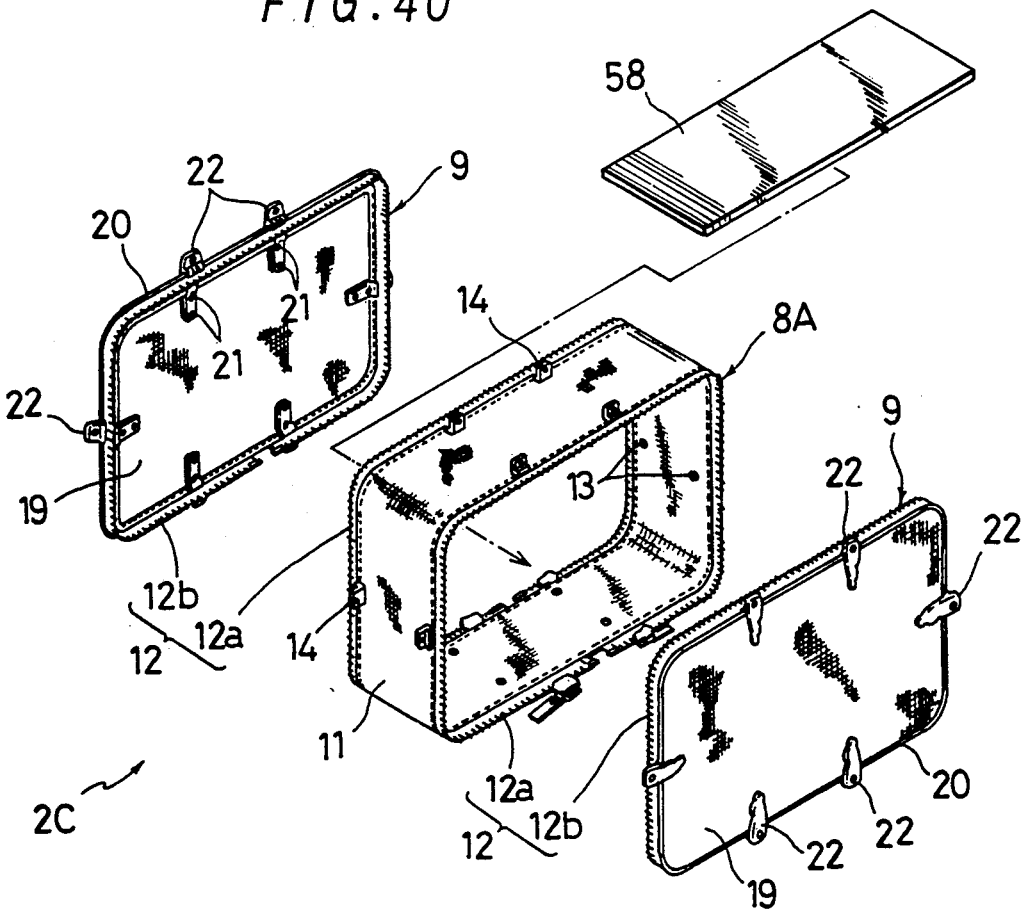

A third embodiment of the present invention shown in FIGS. 38 to 40 is distinguished from the first embodiment by the fact that a small-sized component case 2C has a small-sized frame 8A which comprises an outer frame coat 11, six pairs of joiner blocks 14, and a bottom plate 58 without the use of a small-sized frame structure. A combination trunk 1F containing the two small-sized cases 2C,2C will also offer the same advantages as of the first embodiment of the present invention.

The cover 9 of the small-sized case 2C may have a handle grip 7A mounted at both ends to the two joiners 22,22 as shown in FIG. 39.

The frame 29 of the medium-sized case 3 may be formed without the use of the frame structure 31. Also, the frame 36 of the large-sized case 4 may be formed with no use of the frame structure 38.

Figure 41:
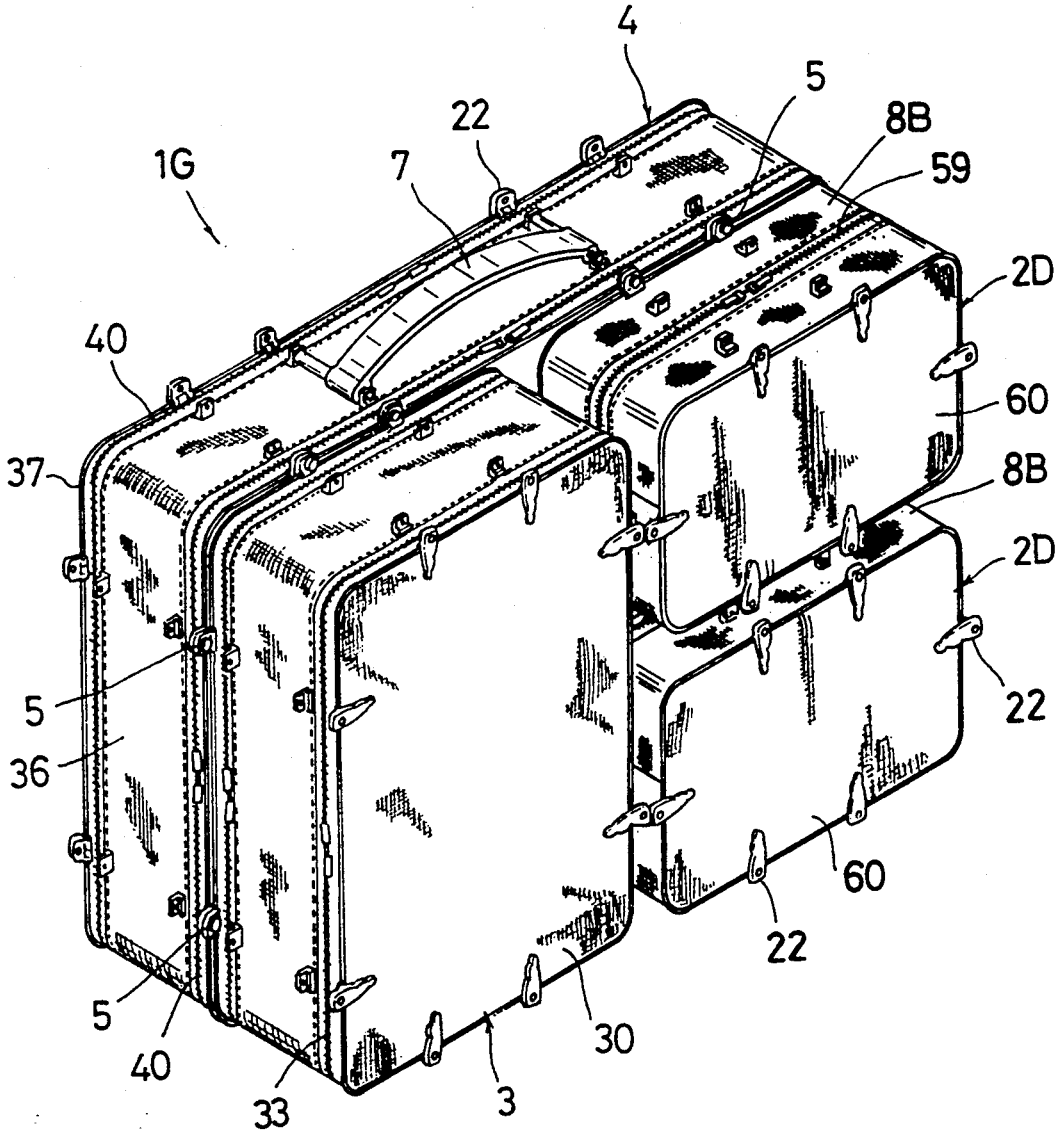
Figure 42:
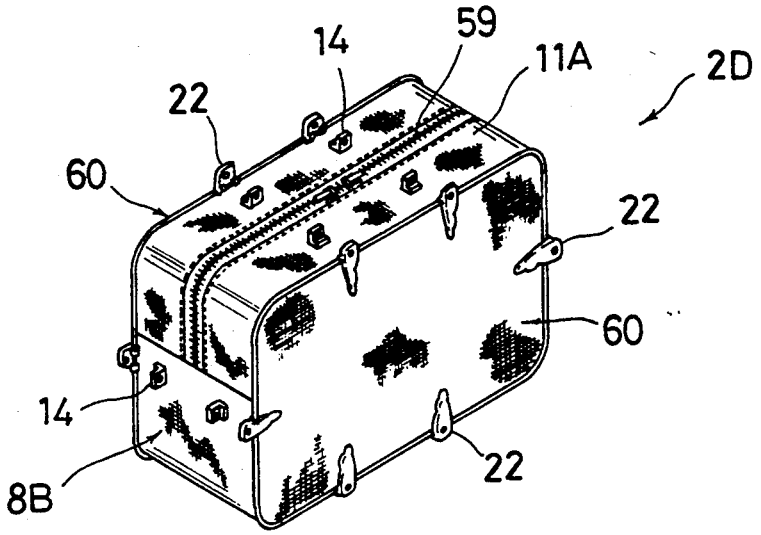
Figure 43:
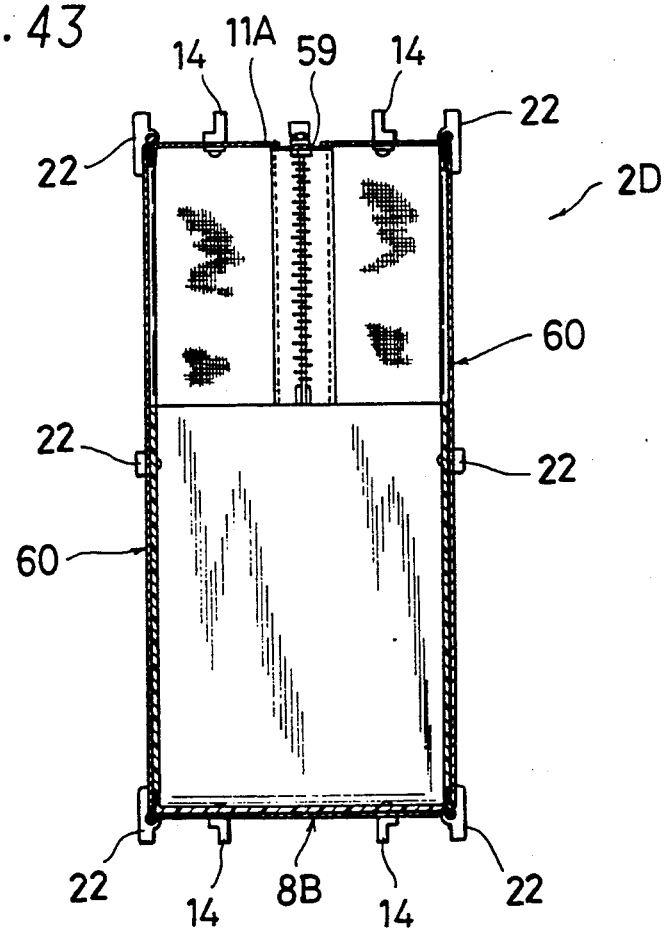

A fourth embodiment of the present invention shown in FIGS. 41 to 43 is distinguished from the first embodiment by the fact that the small-sized component case 2 is replaced with an arrangement 2D which comprises a small-sized frame 8B having an outer frame coat 11A provided at its upper center with a zip-fastener 59 for opening and closing and six pairs of the joiner blocks 14 mounted to the outer frame coat 11A, two closing plates 60,60 covering the two sides of the small-sized frame 8B, and six pairs of the fasteners 22 mounted to the two closing plates 60,60. A combination trunk 1G containing the two small-sized cases 2D,2D will offer the same advantages as the first embodiment of the present invention.

Although a zip-fastener is used for joining between the frame and the cover throughout the foregoing embodiments of the present invention, it is not intended to be limitative and another opening and closing means such as a hinge with a lock mechanism will be employed with equal success.

While the present invention is herein described preferably with respect to a combination of small-sized component cases, a medium-sized component case, and a large-sized component case, any modification may be made having, for example, two smaller-sized component cases coupled to the cover of the small-sized component case or two large-sized component cases coupled side by side.

As set forth above, the present invention will provide the following advantages:

(1) The components cases can be coupled to each other in the depthwise, widthwise, and vertical directions, thus determining a given size appropriate to the purpose of use.

(2) While a plurality of the component cases are coupled together, its corresponding number of container spaces can be acquired for best efficient use.

(3) A larger container space can be provided by coupling two or more of the open frames of the component cases.

(4) The component cases of different sizes which are arranged in a ratio of about 2:1 can be coupled for having a desired size and shape for ease of use.

What is claimed is:

1. A combination trunk comprising:

a frame having opposed openings and separate toothed strips of a sip-fastener mounted in said opposed openings;

said frame having upper, lower, left and right sides;

at least six pairs of joiner blocks mounted to said frame at the upper, lower, left and right sides of the frame so that the joiner blocks extend outward from locations of the frame that are close to edges of said openings;

a separate cover releasably covering each of said openings of the frame, each cover having an edge with a zip-fastener strip mounted to the edge of each cover; and at least six joiners mounted to specific locations of the edge of each cover at locations corresponding to the joiner blocks of the frame.

2. A combination trunk according to claim 1, wherein the frame is comprised mainly of a frame structure of four sided tubular shape made of synthetic resin or wooden sheet material and having an outer surface, an outer frame coat having edges and being made of natural or synthetic leather or cloth material covering the outer surface of the frame, and said separate toothed strips of a zip-fastener are sewed down to the edges of the outer frame coat.

3. A combination trunk according to claim 1, wherein the frame is comprised mainly of an outer frame coat made of natural or synthetic leather or cloth material and wherein the separate toothed strips of a zip-fastener are sewed down to the outer frame coat adjacent said openings.

4. A combination trunk comprising:

a zip-fastener having first and second toothed strips;

a box frame having a closed side and having an opening side opposed to said closed side, said opening having an edge, said first toothed strip being mounted to the edge of the opening;

said box frame having upper, lower, left and right sides;

at least six pairs of joiner blocks mounted to the upper, lower, left and right sides of the box frame to extend outward from locations of the frame adjacent said edge;

at least six depthwise joiners mounted to specific locations of the closed side of the box frame corresponding to the joiner blocks of the upper, lower, left and right sides of the frame;

a cover having an edge, the second toothed strip strips of the zip-fastener mounted to the edge of the cover and releasably covering the opening side of the box frame; and at least six depthwise joiners mounted to specific locations of the edge of the cover corresponding to the positions of the joiner blocks of the frame.

5. A combination trunk comprising:

at least one small-sized component case comprising a small-sized frame having upper, lower, left and right sides, and a pair of opposed opening sides having edges, at least six pairs of outwardly extending joiner blocks mounted to the upper, lower, left and right sides of the small-sized frame, two small-sized covers releasably covering separate opening sides of the small-sized frame, said covers having edges, and at least six depthwise joiners mounted to specific locations of the edge of each small-sized cover corresponding to the locations of joiner blocks of the small-sized frame;

at least one double-sized component case comprising a second frame that is twice as large as the small-sized component case, said double-sized component case having upper, lower, left and right sides, a pair of opposed opening sides having edges, at least eight pairs of outwardly extending joiner blocks mounted to the upper, lower, left, and right sides of the second frame, two second covers having edges and releasably covering the two opening sides of the second frame, and at least eight depthwise joiners mounted to specific locations of the edge of each second cover corresponding to the eight joiner blocks of the second frame; and joiner plates for coupling the small-sized component case and the double-sized component to one another in both horizontal and vertical directions.

6. A combination trunk according to claim 5, wherein each of the small-sized and double-sized frames is comprised mainly of a frame structure of four sided tubular shape made of synthetic resin or wooden plate material and having an outer surface, an outer frame coat made of natural or synthetic leather or cloth material covering the outer surface or the respective frame, and separate toothed strips of a zip-fastener sewed down to both opening sides of the outer frame coat respectively.

7. A combination trunk according to claim 5, wherein each of the small-sized and double-sized frames is comprised mainly of an outer frame coat made of natural or synthetic leather or cloth material on separate toothed strips of a zip-fastener sewed down to the opening sides of the outer frame coats.

8. A combination trunk comprising:

at least one small-sized component case comprising a small-sized frame having upper, lower, left and right sides and a first and second opposed opening sides, at least six pairs of outwardly extending joiner blocks mounted to the upper, lower, left and right sides of the small-sized frame, two small-sized covers separately releasably covering the sized covers separately releasably covering the first and second opening sides of the small-sized frame and having edges, and at least six depthwise joiners mounted to specific locations of the edge of each small-sized cover corresponding to the six joiner blocks of the small-sized frame;

at least one medium-sized component case comprising a medium-sized frame that is twice as large as the small-sized component case, said medium-sized case having upper, lower, left and right sides and fist and second opposed opening sides, at least eight pairs of outwardly extending joiner blocks mounted to the upper, lower, left and right sides of the medium-sized frame, separate medium-sized covers having edges and releasably covering the first and second opening sides of the medium-sized frame, and at least eight depthwise joiners mounted to specific locations of the edge of each medium-sized cover corresponding to the eight joiner blocks of the medium-sized frame;

at least one large-sized component case comprising a large-sized frame that is twice as large as the medium-sized component case and has upper, lower, left and right sides and first and second opening sides, at least twelve pairs of outwardly extending joiner blocks mounted to the upper, lower, left, and right sides of the large-sized frame, two large-sized covers having edges and releasably covering the first and second opening sides of the large-sized frame, and at least twelve depthwise joiners mounted to specific locations of the edge of each large-sized cover corresponding to the locations of the twelve joiner blocks of the large-sized frame; and joiner plates for coupling the small-sized, medium-sized, and large-sized component cases to one another in both horizontal and vertical directions.

9. A combination trunk according to claim 8, wherein each of the small-sized, medium-sized, and large-sized frames is comprised mainly of a frame structure of four-sided tubular shape having an outer surface and being made of synthetic resin or wooden sheet material, an outer frame coat made of natural or synthetic leather or cloth material covering the outer surface of the respective frame, and separate toothed strips of a zip-fastener sewed down to the first and second opening side ends of the outer frame coat of the small-sized, medium-sized and large-sized frames.

10. A combination trunk according to claim 8, wherein each of the small-sized, medium-sized and large-sized frames is comprised mainly of an outer frame coat made of natural or synthetic leather or cloth material and separate toothed strips of a zip-fastener are sewed down to the first and second opening sides of the outer frame coat of said small-sized, medium-sized and large-sized frame.

* * * * *